US009206538B2

(12) United States Patent
Suel, II

(10) Patent No.: US 9,206,538 B2
(45) Date of Patent: Dec. 8, 2015

(54) WASHING MACHINE APPLIANCE AND METHOD FOR CALCULATING A LOAD SIZE OF ARTICLES

(71) Applicant: General Electric Company, Schenectady, NY (US)

(72) Inventor: Richard Dean Suel, II, Louisville, KY (US)

(73) Assignee: General Electric Company, Schenectady, NY (US)

( * ) Notice: Subject to any disclaimer, the term of this patent is extended or adjusted under 35 U.S.C. 154(b) by 45 days.

(21) Appl. No.: 14/031,358

(22) Filed: Sep. 19, 2013

(65) Prior Publication Data

US 2015/0074918 A1 Mar. 19, 2015

(51) Int. Cl.
*D06F 39/00* (2006.01)
*D06F 33/02* (2006.01)

(52) U.S. Cl.
CPC ..... *D06F 33/02* (2013.01); *D06F 39/003* (2013.01); *D06F 2202/10* (2013.01); *D06F 2202/12* (2013.01); *D06F 2204/065* (2013.01)

(58) Field of Classification Search
CPC ..... D06F 2204/065; D06F 2204/06
USPC ..... 8/158
See application file for complete search history.

(56) References Cited

U.S. PATENT DOCUMENTS

| | | | | |
|---|---|---|---|---|
| 7,930,786 | B2 * | 4/2011 | La Belle et al. | 8/159 |
| 7,958,584 | B2 | 6/2011 | Suel et al. | |
| 7,958,585 | B2 | 6/2011 | Zhang et al. | |
| 2007/0278319 | A1 | 12/2007 | Jenkins et al. | |

* cited by examiner

*Primary Examiner* — Michael Barr
*Assistant Examiner* — Rita Adhlakha
(74) *Attorney, Agent, or Firm* — Dority & Manning, P.A.

(57) ABSTRACT

The present subject matter provides a washing machine appliance and a method for operating a washing machine appliance. The method includes determining an average power delivered to a motor of the washing machine appliance while a basket is rotating at a first angular velocity, establishing a plurality of instantaneous powers delivered to the motor while the basket is accelerating from the first angular velocity, and calculating a load score of articles within a wash chamber of the basket based at least in part on the average power delivered to the motor and the plurality of instantaneous powers delivered to the motor. The load score can correspond to a mass of articles within the wash chamber of the basket.

8 Claims, 4 Drawing Sheets

WASHING MACHINE APPLIANCE AND METHOD FOR CALCULATING A LOAD SIZE OF ARTICLES

FIELD OF THE INVENTION

The present subject matter relates generally to washing machine appliances and methods for operating washing machine appliances. More particularly, the present subject matter relates to methods for determining a load score or mass of articles within a wash chamber of a washing machine appliance.

BACKGROUND OF THE INVENTION

Washing machine appliances generally include a tub for containing washing fluid, e.g., water, detergent, and/or bleach, during operation of such washing machine appliances. A basket is rotatably mounted within the tub and defines a wash chamber for receipt of articles for washing. During operation of such washing machine appliances, washing fluid is directed into the tub and onto articles within the wash chamber of the basket. The basket can rotate at various speeds to agitate articles within the wash chamber in the washing fluid, to wring washing fluid from articles within the wash chamber, etc.

During operation of certain washing machine appliances, a volume of water is directed into the tub in order to form washing fluid and/or rinse articles within the wash chamber of the basket. The volume of water can vary depending upon a variety of factors. For example, large loads can require a large volume of water relative to small loads that can require a small volume of water.

To operate efficiently, the volume of water directed into the tub preferably corresponds or correlates to a size of a load of articles within the wash chamber of the basket. Thus, large volumes of water are preferably directed into the washing machine's tub for large loads in order to properly wash such loads. Conversely, small volumes of water are preferably directed into the washing machine's tub for small loads in order to properly wash such loads. Directing an improper volume of water into the basket can waste valuable water and/or energy and can also hinder proper cleaning of articles within the wash chamber of the basket. However, accurately and/or precisely determining the size of a load of articles within the wash chamber of the basket can be difficult. In particular, friction and other forces that hinder rotation of the basket can change over time, and accurately and/or precisely determining the size of a load of articles within the wash chamber of the basket can be difficult due to changes in friction and other forces that hinder rotation of the basket over time.

Accordingly, a method for operating a washing machine appliance that can assist with determining a mass of articles within a wash chamber of a basket of the washing machine appliance would be useful. In particular, a method for operating a washing machine appliance that can assist with determining a mass of articles within a wash chamber of a basket of the washing machine appliance while accounting for changes in friction within the washing machine appliance would be useful.

BRIEF DESCRIPTION OF THE INVENTION

The present subject matter provides a washing machine appliance and a method for operating a washing machine appliance. The method includes determining an average power delivered to a motor of the washing machine appliance while a basket is rotating at a first angular velocity, establishing a plurality of instantaneous powers delivered to the motor while the basket is accelerating from the first angular velocity, and calculating a load score of articles within a wash chamber of the basket based at least in part on the average power delivered to the motor and the plurality of instantaneous powers delivered to the motor. The load score can correspond to a mass of articles within the wash chamber of the basket. Additional aspects and advantages of the invention will be set forth in part in the following description, or may be apparent from the description, or may be learned through practice of the invention.

In a first exemplary embodiment, a washing machine appliance is provided. The washing machine appliance includes a tub and a basket rotatably mounted within the tub. The basket defines a wash chamber for receiving articles for washing. A motor is in mechanical communication with the basket. The motor is configured for selectively rotating the basket within the tub. A controller is in operative communication with the motor. The controller is configured for operating the motor in order to rotate the basket at a first angular velocity, determining an average power delivered to the motor during the step of operating, increasing an angular velocity of the basket with the motor after the step of operating, establishing a plurality of instantaneous powers delivered to the motor during the step of increasing, and calculating a load score of articles within the wash chamber of the basket based at least in part on the average power delivered to the motor during the step of operating and the plurality of instantaneous powers delivered to the motor during the step of increasing. The load score is proportional to a load size of articles within the wash chamber of the basket.

In a second exemplary embodiment, a method for operating a washing machine appliance is provided. The method includes operating a motor of the washing machine appliance in order to rotate a basket of the washing machine appliance at a first angular velocity, determining an average power delivered to the motor of the washing machine appliance during the step of operating, increasing an angular velocity of the basket of the washing machine appliance with the motor of the washing machine appliance after the step of operating, establishing a plurality of instantaneous powers delivered to the motor of the washing machine appliance during the step of increasing, and calculating a load score of articles within a wash chamber of the basket based at least in part on the average power delivered to the motor of the washing machine appliance during the step of operating and the plurality of instantaneous powers delivered to the motor of the washing machine appliance during said the of increasing. The load score is proportional to a load size of articles within the wash chamber of the basket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
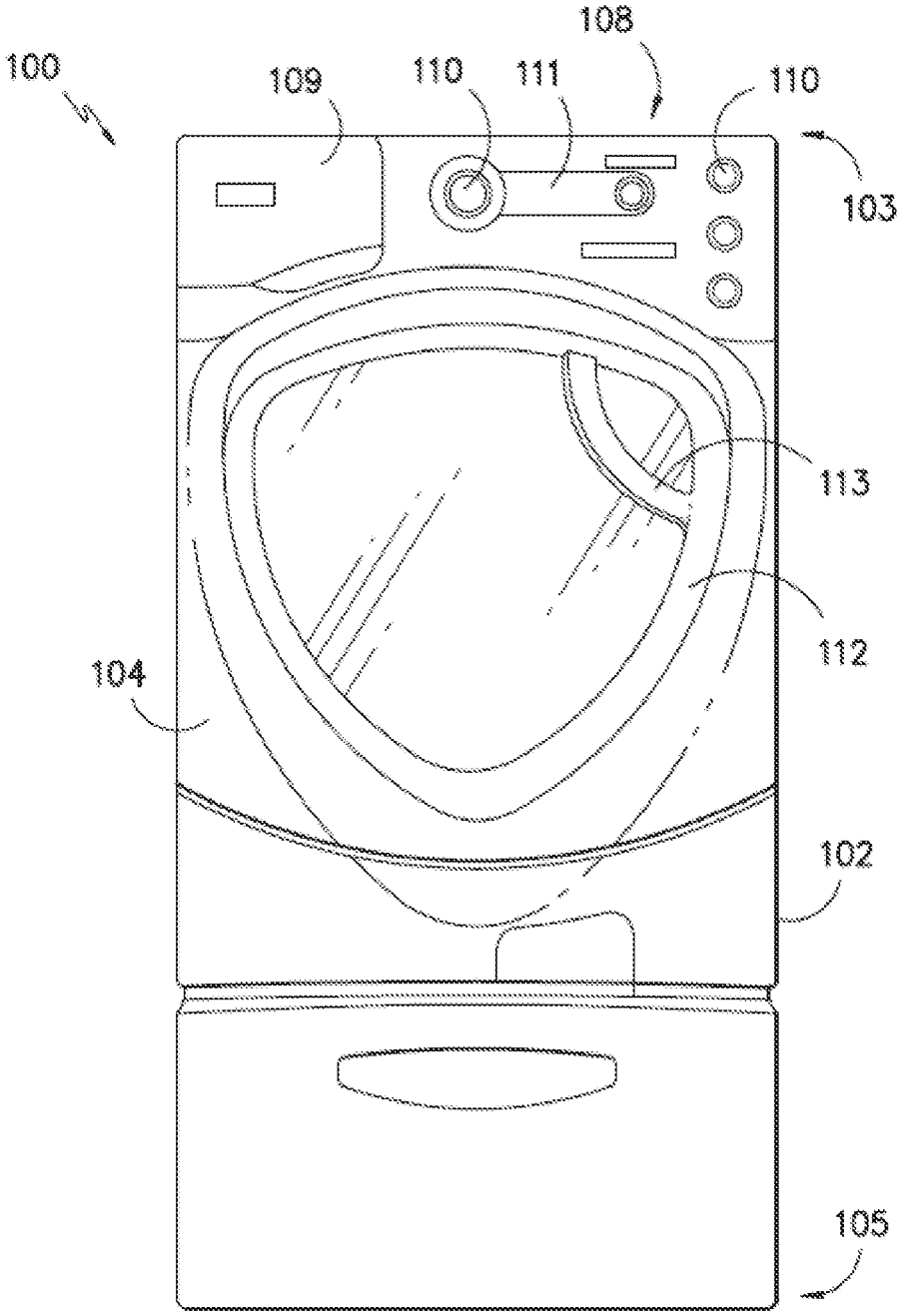
FIG. 1 provides a front, elevation view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
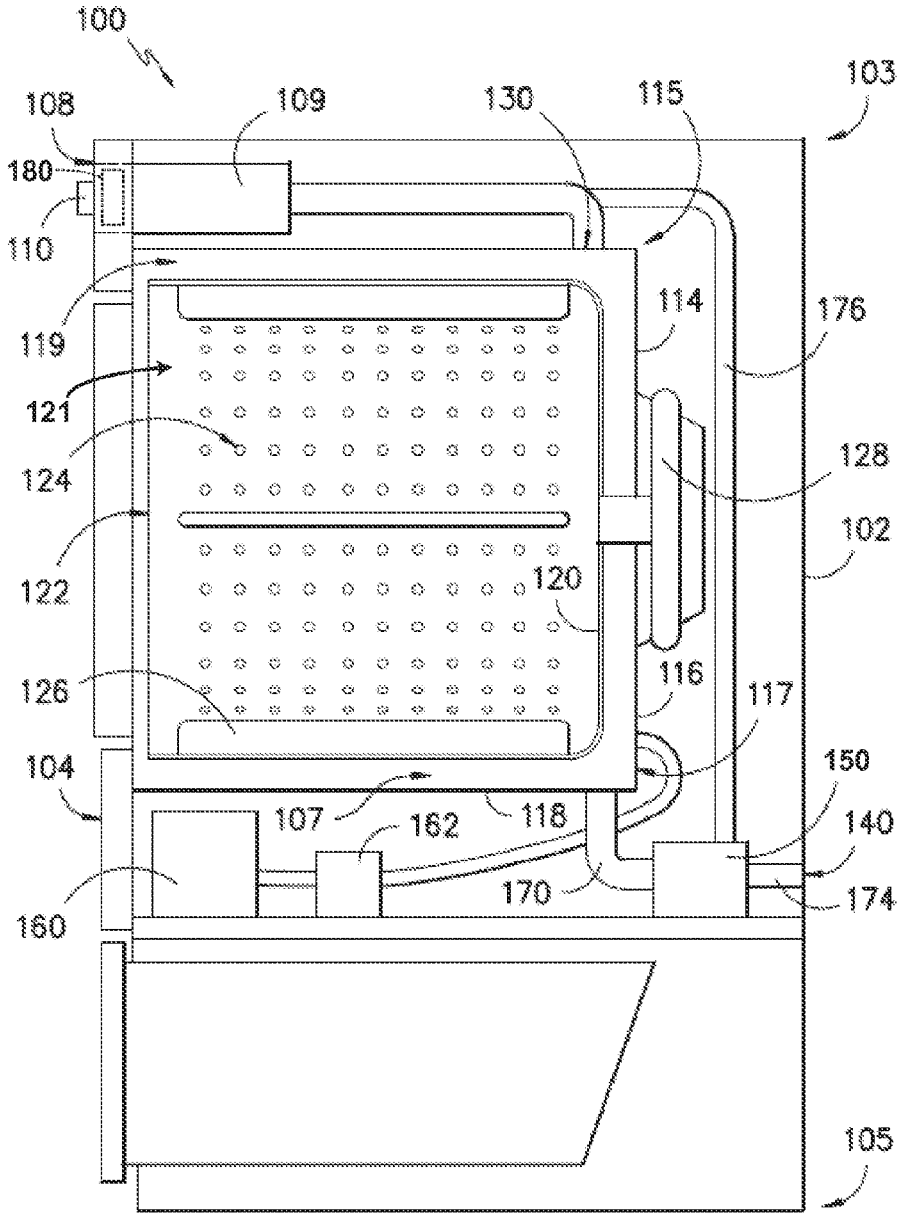
FIG. 2 provides a side, section view of the exemplary washing machine appliance of FIG. 1.

FIG. 1 provides a front, elevation view of an exemplary horizontal axis washing machine appliance 100. FIG. 2 provides a side, section view of washing machine appliance 100. As may be seen in FIG. 1, washing machine appliance 100 includes a cabinet 102 that extends between a top portion 103 and a bottom portion 105, e.g., along a vertical direction. Cabinet 102 also includes a front panel 104. A door 112 is mounted to front panel 104 and is rotatable about a hinge (not shown) between an open position facilitating access to a wash drum or basket 120 (FIG. 2) located within cabinet 102, and a closed position (shown in FIG. 1) hindering access to basket 120. A user may pull on a handle 113 in order to adjust door 112 between the open position and the closed position.

A control panel 108 including a plurality of input selectors 110 is coupled to front panel 104. Control panel 108 and input selectors 110 collectively form a user interface input for operator selection of machine cycles and features. For example, in one embodiment, a display 111 indicates selected features, a countdown timer, and/or other items of interest to machine users.

Referring now to FIG. 2, a tub 114 defines a wash compartment 119 configured for receipt of a washing fluid. Thus, tub 114 is configured for containing washing fluid, e.g., during operation of washing machine appliance 100. Washing fluid disposed within tub 114 may include at least one of water, fabric softener, bleach, and detergent. Tub 114 includes a back wall 116 and a sidewall 118 and also extends between a top 115 and a bottom 117, e.g., along the vertical direction.

Basket 120 is rotatably mounted within tub 114 in a spaced apart relationship from tub sidewall 118 and the tub back wall 116. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of washing machine appliance 100. For example, during operation of washing machine appliance 100, washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of washing machine appliance 100 in order to remove fluid from tub 114. Fluid received by drain 140 from pump assembly 150 is directed out of washing machine appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of washing machine appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. Ribs 126 extend from basket 120 into wash compartment 119. Ribs 126 assist agitation of articles disposed within wash compartment 119 during operation of washing machine appliance 100. For example, ribs 126 may lift articles disposed in basket 120 during rotation of basket 120.

A drawer 109 is slidably mounted within front panel 104. Drawer 109 receives a fluid additive (e.g., detergent, fabric softener, bleach, or any other suitable liquid) and directs the fluid additive to wash compartment 119 during operation of washing machine appliance 100. Additionally, a reservoir 160 is disposed within cabinet 102. Reservoir 160 is also configured for receipt of fluid additive for use during operation of washing machine appliance 100 (shown in FIG. 1). Reservoir 160 is sized such that a volume of fluid additive sufficient for a plurality or multitude of wash cycles of washing machine appliance 100 may fill reservoir 160. Thus, for example, a user can fill reservoir 160 with fluid additive and operate washing machine appliance 100 for a plurality of wash cycles without refilling reservoir 160 with fluid additive. A reservoir pump 162 is configured for selective delivery of the fluid additive from reservoir 160 to tub 114.

Operation of washing machine appliance 100 is controlled by a processing device or controller 180 that is operatively coupled to control panel 108 for user manipulation to select washing machine cycles and features. In response to user manipulation of control panel 108, controller 180 operates the various components of washing machine appliance 100 to execute selected machine cycles and features.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of washing machine appliance 100 may be in communication with controller 180 via one or more signal lines or shared communication busses.

Controller 180 is in operative communication with motor 128. Thus, controller 180 can selectively activate and operate motor 128, e.g., depending upon a cycle selected by a user of washing machine appliance 100. Controller 180 is also configured for monitoring a power delivered to motor 128. As will be understood by those skilled in the art, power delivered to motor 128 can be measured or determined by controller 180 utilizing various methods. As an example, controller 180 or motor 128 may include a power measurement circuit. In alternative exemplary embodiments, controller 180 may monitor the power delivered to motor 128 utilizing any other suitable mechanism or method.

In an illustrative example of operation of washing machine appliance 100, laundry items are loaded into basket 120, and washing operation is initiated through operator manipulation of input selectors 110. Tub 114 is filled with water and detergent to form a washing fluid. One or more valves (not shown) can be actuated by controller 180 to provide for filling tub 114 to the appropriate level for the amount of articles being washed. Once tub 114 is properly filled with washing fluid, the contents of basket 120 are agitated with ribs 126 for cleaning of laundry items in basket 120.

After the agitation phase of the wash cycle is completed, tub 114 is drained. Laundry articles can then be rinsed by again adding washing fluid to tub 114, depending on the particulars of the cleaning cycle selected by a user, ribs 126 may again provide agitation within wash compartment 119. One or more spin cycles may also be used. In particular, a spin cycle may be applied after the wash cycle and/or after the rinse cycle in order to wring washing fluid from the articles being washed. During a spin cycle, basket 120 is rotated at relatively high speeds.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Figure 3:
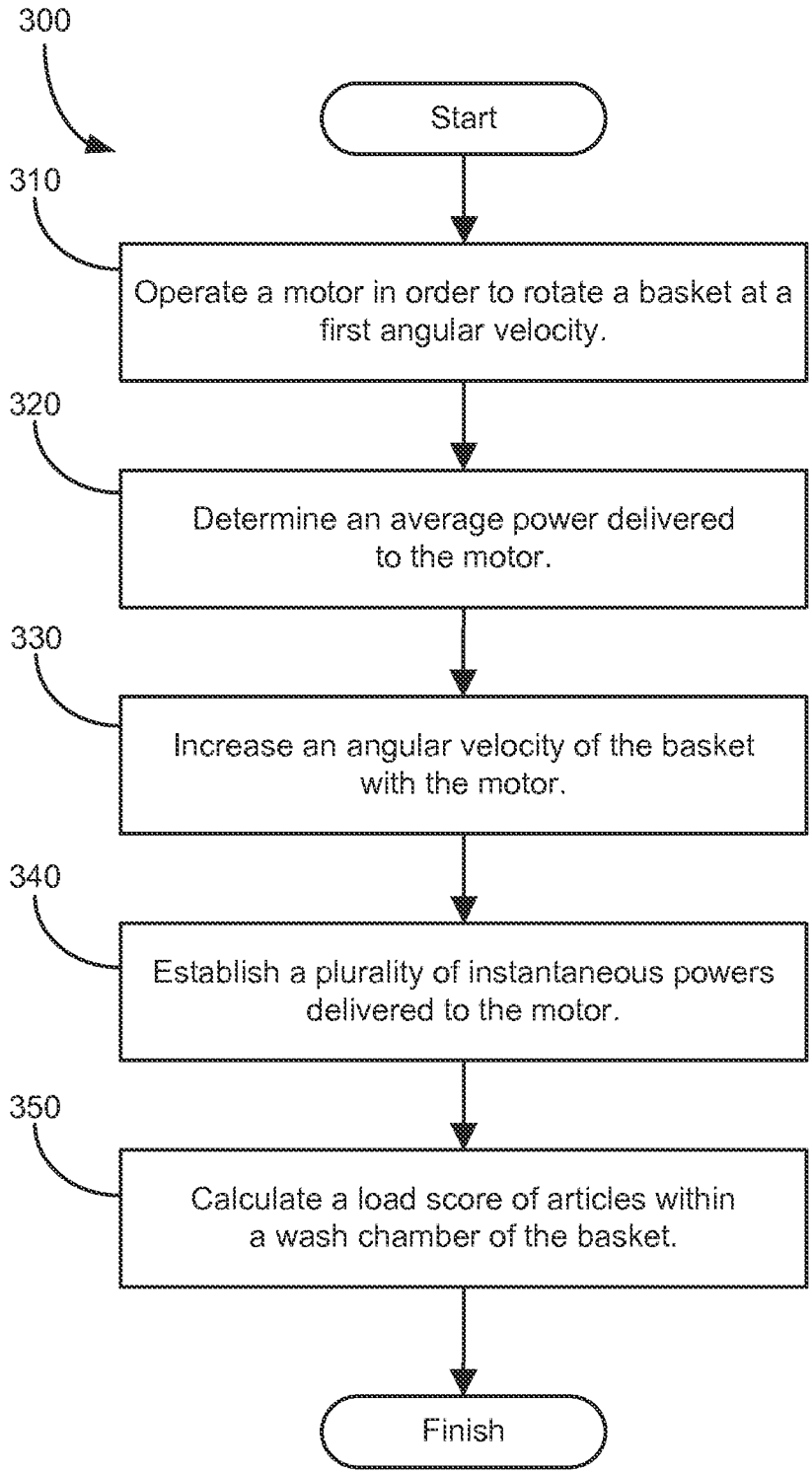
FIG. 3 illustrates a method for operating a washing machine appliance according to an exemplary embodiment of the present subject matter.
Figure 4:
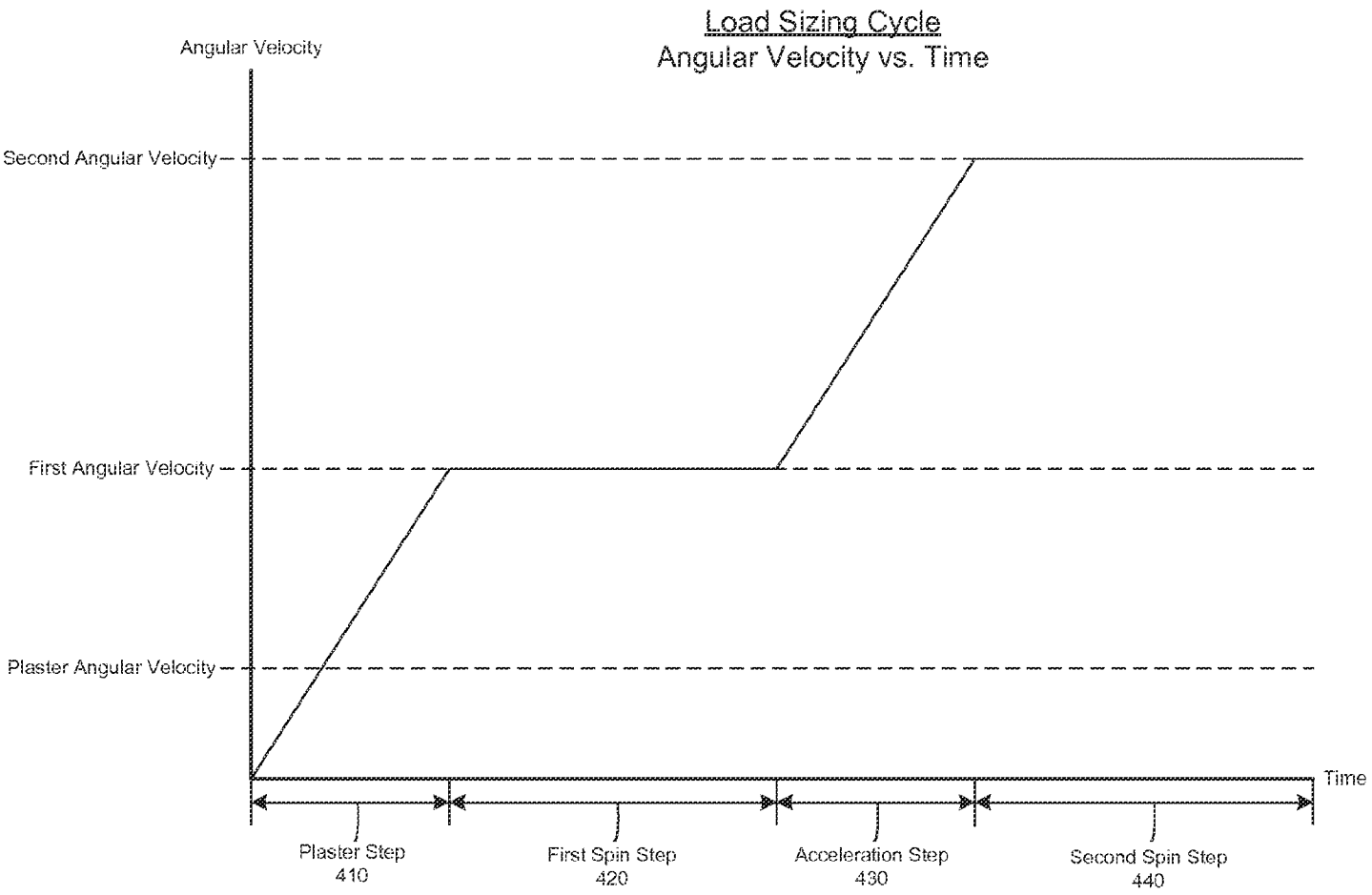
FIG. 4 provides a plot of an angular velocity of a basket over time during a load sizing cycle of a washing machine appliance.

FIG. 3 illustrates a method 300 for operating a washing machine appliance according to an exemplary embodiment of the present subject matter. Method 300 can be used to operate any suitable washing machine appliance. For example, method 300 may be used to operate washing machine appliance 100 (FIG. 1). In particular, controller 180 may be programmed or configured to implement method 300. Utilizing method 300, a load size of articles within wash chamber 121 of basket 120 can be estimated or measured. In particular, a mass of articles within wash chamber 121 of basket 120 can be estimated or measured utilizing method 300. FIG. 4 provides a plot of an angular velocity of basket 120 over time during a load sizing cycle of washing machine appliance 100. Method 300 can be performed during the load sizing cycle of washing machine appliance 100 shown in FIG. 4. Method 300 is discussed in greater detail below in the context of the load sizing cycle illustrated in FIG. 4.

As may be seen in FIG. 4, the load sizing cycle includes a plaster step 410. During plaster step 410, controller 180 operates motor 128. In particular, motor 128 can accelerate basket 120 such that an angular velocity of basket 120 increases, e.g., to about a first angular velocity, during the plaster step 410. The first angular velocity can be any suitable angular velocity. For example, the first angular velocity may be greater than a plaster angular velocity of articles within wash chamber 121 of basket 120. Thus, when motor 128 rotates basket 120 at the first angular velocity, articles within wash chamber 121 of basket 120 can be plastered against and/or stick to basket 120 because the angular velocity of basket 120 exceeds the plaster angular velocity of basket 120. With articles within wash chamber 121 of basket 120 plastered against basket 120, articles within wash chamber 121 can be substantially stationary or fixed relative to basket 120 during rotation of basket 120.

At step 310, controller 180 operates motor 128 in order to rotate basket 120 at the first angular velocity. At step 320, controller 180 determines an average power delivered to motor 128, e.g., during step 310. For example, as shown in FIG. 4, motor 128 rotates basket 120 at the first angular velocity during a first spin step 420 of the load sizing cycle. At step 320, controller 180 can determine the average power delivered to motor 128 during the entirety of the first spin step 420 or during a portion of the first spin step 420. As will be under stood by those skilled in the art, a power delivered to motor 128 when basket 120 is rotating at a constant angular velocity can correspond to about a power required to overcome friction and other static factors hindering rotation of basket 120, e.g., because basket 120 is not accelerating. Thus, the average power delivered to motor 128 determined at step 320 can be used to estimate or gauge the friction and other steady state losses within motor 128 and other components of washing machine appliance 100 that impede rotation of basket 120.

At step 330, the angular velocity of basket 120 is increased. As an example, controller 180 can operate motor 128 in order to increase the angular velocity of basket 120, e.g., after step 310. In particular, controller 180 can increase the angular velocity of basket 120 from about the first angular velocity to about a second angular velocity with motor 128 at step 330. The second angular velocity can be any suitable angular velocity. For example, the second angular velocity may be greater than the first angular velocity.

At step 340, controller 180 establishes a plurality of instantaneous powers delivered to motor 128, e.g., during step 330. As an example, an instantaneous power may be measured about every ten milliseconds during step 330 in order to establish the plurality of instantaneous powers delivered to motor 128 at step 340. As may be seen in FIG. 4, motor 128 increases the angular velocity of basket 120 from about the first angular velocity to about the second angular velocity during an acceleration step 430 of the load sizing cycle. At step 340, controller 180 can determine the plurality of instantaneous powers delivered to motor 128 during the entirety of the acceleration step 430 or during a portion of the acceleration step 430. As will be under stood by those skilled in the art, the power delivered to motor 128 when basket 120 is accelerating can correspond to about a power required to overcome friction and other static factors hindering rotation of basket 120 as well as the power required to accelerate basket 120. Thus, each instantaneous power delivered to motor 128 during step 330 can be used to estimate or gauge the power required to accelerate basket 120 after accounting for the friction and other steady state losses within motor 128 and other components of washing machine appliance 100 that impede rotation of basket 120.

At step 350, controller 180 calculates a load score of articles within wash chamber 121 of basket 120 based at least in part on the average power delivered to motor 128 during step 320 and the plurality of instantaneous powers delivered to motor 128 during step 330. The load score is, e.g., directly, proportional to a load size of articles within wash chamber 121 of basket 120. As an example, the load score of articles within wash chamber 121 of basket 120 may be calculated with the following at step 350, $$\text{Load Score} = \sum_{t_0}^{t_i}\left(P(t) - P_{avg,ss} * \frac{n(t)}{n_{avg,ss}}\right)$$

where

P is an instantaneous power delivered to motor 128 at time t during step 330, $P_{avg,ss}$ is the average power delivered to motor 128 during step 310, n is an angular velocity of basket 120 at time t during step 330, and $n_{avg,ss}$ is the first angular velocity.

Thus, the load score of articles within wash chamber 121 of basket 120 can correspond to a sum of the difference between each instantaneous power delivered to motor 128 at step 330 and a product of the average power delivered to motor 128 during step 310 and a weighting or scaling factor, where the weighting factor is a quotient of the angular velocity of basket 120 at time t and the first angular velocity.

The load score of articles within wash chamber 121 of basket 120 can be directly proportional to a mass, m, of articles within wash chamber 121 of basket 120 such that $$m \propto \text{Load Score}$$

Thus, method 300 can also include correlating the load score of articles within wash chamber 121 of basket 120 to the mass of articles within wash chamber 121 of basket 120. For example, controller 180 can obtain an associated mass of the load score from a lookup table or a function, such as a transfer function, within the memory of controller 180.

Method 300 can also include directing a predetermined volume of liquid water into tub 114, e.g., after step 350. The predetermined volume may be selected based at least in part on the load score of articles within wash chamber 121 of basket 120. Thus, controller 180 can direct a first volume of water into wash tub 114 of washing machine appliance 100 during a wash cycle of washing machine appliance 100 if the load score or mass of articles within wash chamber 121 of basket 120 is relatively large. Conversely, controller 180 can direct a second volume of water into wash tub 114 of washing machine appliance 100 during the wash cycle of washing machine appliance 100 if the load score or mass of articles within wash chamber 121 of basket 120 is relatively small. The first and second volumes are different. In particular, the first volume may be greater than the second volume. In such a manner, controller 180 can direct more water into wash tub 114 if the mass of articles within wash chamber 121 of basket 120 is relatively large. Conversely, controller 180 can direct less water into wash tub 114 if the mass of articles within wash chamber 121 of basket 120 is relatively small. Thus, method 300 can assist with conserving water if relatively small loads of articles are positioned within wash chamber 121 of basket 120.

It should be understood that method 300 can also include repeating steps 310, 320, 330, 340 and 350 and calculating an average load score for articles within wash chamber 121 of basket 120. Repeating steps 310-350 can improve the accuracy and/or consistency of method 300. However, repeating steps 310, 320, 330, 340 and 350 can increase a duration or time interval of method 300.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, comprising:

operating a motor of the washing machine appliance in order to rotate a basket of the washing machine appliance at a first angular velocity;

determining an average power delivered to the motor of the washing machine appliance during said step of operating;

increasing an angular velocity of the basket of the washing machine appliance with the motor of the washing machine appliance after said step of operating;

establishing a plurality of instantaneous powers delivered to the motor of the washing machine appliance during said step of increasing; and calculating a load score of articles within a wash chamber of the basket with the following $$\text{Load Score} = \sum_{t_0}^{t_i}\left(P(t) - P_{avg,ss} * \frac{n(t)}{n_{avg,ss}}\right)$$

where

P in an instantaneous power delivered to the motor at a time t, $P_{avg,ss}$ is the average power delivered to the motor during said step of operating, n is an angular velocity of the basket at time t, and $n_{avg,ss}$ is the first angular velocity, the load score being proportional to a load size of articles within the wash chamber of the basket, and directing a predetermined volume of liquid water into a tub of the washing machine appliance after said calculating, the predetermined volume selected based at least in part on the load score of articles within the wash chamber of the basket.

2. The method of claim 1, further comprising correlating the load score of articles within the wash chamber of the basket to a mass of articles within the wash chamber of the basket.

3. The method of claim 2, wherein said step of correlating comprises obtaining an associated mass of the load score in a lookup table of the washing machine appliance.

4. The method of claim 1, wherein the first angular velocity is selected such that articles within wash chamber of basket plaster on the basket.

5. The method of claim 1, wherein said step of increasing comprises increasing the angular velocity of the basket from the first angular velocity to a second angular velocity with the motor of the washing machine appliance after said step of operating, the second angular velocity being greater than the first angular velocity.

6. The method of claim 1, wherein the instantaneous powers of the plurality of instantaneous powers are established about every ten milliseconds during said step of establishing.

7. The method of claim 1, wherein the basket is configured for rotation on a substantially horizontal axis.

8. The method of claim 1, wherein the basket is configured for rotation on a substantially vertical axis.

* * * * *